US005566772A

United States Patent [19]

Coone et al.

[11] Patent Number: 5,566,772

[45] Date of Patent: Oct. 22, 1996

[54] TELESCOPING CASING JOINT FOR LANDING A CASTING STRING IN A WELL BORE

[75] Inventors: Malcolm Coone, Katy; Thomas L. Kelley, Houston, both of Tex.

[73] Assignee: Davis-Lynch, Inc., Houston, Tex.

[21] Appl. No.: 410,111

[22] Filed: Mar. 24, 1995

[51] Int. Cl.[6] ..... E21B 17/08

[52] U.S. Cl. ..... 175/321; 166/242.7

[58] Field of Search ..... 166/242.7, 285; 175/321, 322

[56] References Cited

U.S. PATENT DOCUMENTS

| | | | |
|---|---|---|---|
| 1,199,029 | 9/1916 | Hovis . | |
| 1,501,217 | 7/1924 | Heeter . | |
| 1,839,690 | 1/1932 | Malinowski . | |
| 1,982,915 | 12/1934 | Jenks | 255/28 |
| 2,029,609 | 2/1936 | Burns et al. | 255/28 |
| 2,422,223 | 6/1947 | Church | 285/146 |
| 2,500,276 | 3/1950 | Church | 166/4 |
| 2,900,028 | 8/1959 | Hanes | 166/242.7 |
| 3,599,735 | 8/1971 | Slator et al. | 175/321 X |
| 3,667,547 | 6/1972 | Ahlstone | 166/286 |
| 3,727,948 | 4/1973 | Current | 285/3 |
| 4,064,953 | 12/1977 | Collins | 175/321 |
| 4,285,533 | 8/1981 | Silberman et al. | 285/2 |
| 4,394,883 | 7/1983 | Briscoe | 175/321 X |

(List continued on next page.)

FOREIGN PATENT DOCUMENTS 1543222 10/1968 France .

OTHER PUBLICATIONS

*Phillips to Run Casing Slip Joints to Counter Downhole Ekofisk Subsidence,* Petroleum Engineer International, Aug. 1992.

*The Fall and Rise of Ekofisk,* D. J. Smith, Exploration & Production Technology International 1990.

*Designing Wells for Subsidence in the Greater Ekofisk Area,* M. C. Bickley and W. E. Curey, Society of Petroleum Engineers, 1992.

Two pages on Lockomatic Expanding Hole Opener from Tri–State Oil Tool Industries, Inc. publication.

Davis–Lynch, Inc. 1986–87 Product Brochure.

Davis–Lynch, Inc. 1993 Equipment Catalog No. 11.

Nodeco brochure from Stavanger, Norway Oil Show, Aug. 1992.

Davis Lynch Subsidence Safety Device.

General Bid Details relating to an invitation by a third party for bids for "casing slip joints".

*Primary Examiner*—Frank Tsay

*Attorney, Agent, or Firm*—Arnold, White & Durkee

[57] ABSTRACT

A casing joint is provided for use in landing a casing string in a well bore for an oil or gas well in a controlled manner so that movement of the casing string relative to the well bore does not cause the casing string to become damaged. The casing joint includes an inner tubular member disposed within an outer tubular member. The casing joint also includes a means for causing the inner tubular member to move axially relative to the outer tubular member in response to differential fluid pressures. The casing joint further includes a plurality of shear pins attaching the inner tubular member to the outer tubular member. The shear pins are selected to shear at a predetermined load so as to enable the inner tubular member to move axially relative to the outer tubular member. The casing joint also includes a pair of anti-rotation lugs which prevent the inner tubular member from rotating relative to the outer tubular member. In landing the casing string, the casing joint is placed into the well bore a predetermined distance above the bottom of the well bore. Mud is pumped through the casing joint at a high enough pressure to rupture the shear pins and cause the inner tubular member to extend to the bottom of the well bore. An annular stop ring limits the axial movement of the inner tubular member in the extended condition. Next, the casing joint is cemented into the well bore. The cement is then allowed to harden so that the casing joint bonds to the subsea formation surrounding the bottom of the well bore.

26 Claims, 12 Drawing Sheets

U.S. PATENT DOCUMENTS

| | | | |
|---|---|---|---|
| 4,678,031 | 7/1987 | Blandford et al. | 166/242.7 |
| 4,693,316 | 9/1987 | Ringgenberg et al. | 175/321 X |
| 4,778,008 | 10/1988 | Gonzalez et al. | 166/387 |
| 4,846,273 | 7/1989 | Anderson et al. | 175/321 X |
| 4,889,198 | 12/1989 | Buck | 175/321 X |
| 5,085,273 | 2/1992 | Coone | 166/242 |
| 5,133,419 | 7/1992 | Barrington | 166/242.7 X |
| 5,219,027 | 6/1993 | Taylor | 166/242.7 X |
| 5,275,240 | 1/1994 | Peterson et al. | 166/242 |
| 5,309,996 | 5/1994 | Sutton | 166/286 |

TELESCOPING CASING JOINT FOR LANDING A CASTING STRING IN A WELL BORE

FIELD OF THE INVENTION

The present invention relates generally to placing a casing string in an oil or gas well, and more particularly, is directed to a telescoping casing joint and method for placing, or landing, a casing string in a well bore for an oil or gas well in a controlled manner so that any axial movement of the casing string relative to the well bore does not cause the casing string to become damaged.

BACKGROUND OF THE INVENTION

Some offshore rigs used for drilling oil or gas wells move relative to the sea floor as a result of sea currents and wave motion. This movement can make landing a casing string in the well bore a difficult task. As the drilling rig moves in an up and down motion, the string of casing pipe moves relative to the well bore. If the casing shoe hits the bottom of the well bore before the casing string is properly landed in the casing hanger this can cause the casing string to become damaged. Devices known as motion compensators have been developed to control this movement. These devices utilize a combination of cables, pulleys and hydraulic cylinders. Although motion compensators dampen a significant portion of the movement of the drilling rig, they cannot completely control all of the motion imparted to the drilling rig.

One solution to this problem is to land the casing string a given distance above the bottom of the well bore, typically 15 feet, and cement the casing string in this position before drilling the next section of the well bore. This allows the casing string to move axially relative to the well bore as the drilling rig moves in an up and down motion without the casing shoe hitting the bottom of the well bore before the casing string is properly landed in the casing hanger.

The well bore between the bottom of the casing string and the bottom of the well is sometimes called the rat hole and is of a larger diameter than the outside diameter of the casing being installed. After the casing string has been cemented in place, the next section of the well bore is drilled. Typically, this next section is smaller in diameter than the previously drilled section.

While this solution protects the casing string, as it is being landed, from damage due to the up and down movement of the drilling rig, it is not without drawbacks. When logging and other tools are lowered into the well bore to evaluate the subsea formation conditions in the newly drilled section of the well, they tend to get stuck or "hung up" in the larger diameter rat hole. This is especially likely to occur in deviated wells, that is wells which are drilled at some angle less than 90 degrees to the surface of the sea floor. The greater the angle of incline the greater the possibility that the logging or other tools will get stuck. Once stuck, it is very difficult to recover a tool without damaging it, and sometimes it is impossible to recover the tool at all. Replacement and/or repair of logging and other exploratory tools can be very costly because these devices are very expensive pieces of equipment. Also, the recovery procedure can cause damage to the well which itself may require repair.

Furthermore, the rat hole has a tendency of filling up with formation cuttings and cement chunks. These fillings can cause the drill bit of the drilling tool to get stuck in the rat hole thereby impeding the process of drilling the lower section of the well bore.

The present invention is directed to overcoming or at least minimizing some of the problems mentioned above.

SUMMARY OF THE INVENTION

In one aspect of the present invention, a casing joint for landing a casing string in a well bore in an oil or gas well is provided. The casing joint includes an outer tubular member having a pair of oppositely disposed longitudinal grooves formed along its inner circumferential surface at a first end. The outer tubular member is connectible at a second end to a first section of the casing string. The casing joint further includes an inner tubular member having a pair of oppositely disposed longitudinal grooves formed along its outer circumferential surface. The inner tubular member is partially disposed within the outer tubular member. The inner tubular member is adapted to be axially movable relative to the outer tubular member in a telescoping fashion and connectible at an outer end to a second section of the casing string.

In another aspect of the present invention, the casing joint also includes means for causing the inner tubular member to move axially relative to the outer tubular member in response to differential fluid pressures. In one embodiment, the means for causing the inner tubular member to move axially relative to the outer tubular member includes a series of baffle mechanisms or other flow restricting device coupled to the outer end of the inner tubular member which restricts the flow of fluid through the inner tubular member. In one embodiment, the flow restricting device includes a baffle ring defined by a convergent inner surface having a first end and a second end which has a narrower diameter than the first end, said second end terminating at a basin portion having a plurality of discharge outlets. A closing plug may also be provided which fits within the convergent inner circumferential surface of the baffle ring so as to temporarily block the flow of fluids out of the casing joint. The closing plug is defined by an inner plug having a disk-shape and an outer plug having a hollow inner bore and a plurality of outer branch-like sealing members disposed along its outer surface, wherein the inner plug is disposed within the hollow bore of the outer plug. The inner plug is attached to the outer plug by means of a pin which is adapted to rupture when the fluid pressure in the casing joint reaches a predetermined value.

In another aspect of the invention, the casing joint further includes a plurality of shear elements attaching the inner tubular member to the outer tubular member. The shear elements are selected to shear at a predetermined load so as to allow the inner tubular member to move axially relative to the outer tubular member. A pair of oppositely disposed anti-rotation elements are provided which are placed between the pair of longitudinal grooves formed in the inner and outer tubular members. The pair of anti-rotation elements prevent the inner tubular member from rotating relative to the outer tubular member. An annular stop ring is also provided which is disposed within an annular groove formed in the outer circumferential surface of the inner tubular member. The annular stop ring is adapted to slide into an annular grove formed in the inner circumferential surface of the outer tubular member. It limits the axial movement of the inner tubular member relative to the outer tubular member in an extended condition. The casing joint further includes a pair of elastomeric O-rings which are disposed within annular grooves formed in the outer surface of the inner tubular member. The O-rings hermetically seal the inner tubular member to the outer tubular member.

In yet another aspect of the present invention, the casing joint further includes a guide shoe coupled to the outer end of the inner tubular member which guides the casing joint through the well bore. The guide shoe has a discharge bore disposed along its central axis and a plurality of discharge ports disposed along its outer perimeter through which fluids flow into the well bore. The casing joint further includes a float collar which is attached to the first end of the outer tubular member. The float collar has a valve mechanism which prevents fluids flowing through the casing joint from flowing back up into the casing string.

In another aspect of the invention, a float shoe is coupled to the outer end of the inner tubular member in place of the guide shoe. Like the float collar, the float shoe has a valve mechanism which allows fluids to flow out of the casing joint but which prevents fluids from flowing back into the casing joint. In one embodiment, the means for causing the inner tubular member to move axially relative to the outer tubular member includes a float shoe.

In still another aspect of the present invention, a method is provided for landing a casing string in a well bore for an oil or gas well in a controlled manner so that any axial movement of the casing string relative to the well bore does not cause damage to the casing string. The method includes the step of placing a casing joint into the well bore a predetermined distance above the bottom of the well bore. Next, fluid is pumped through the casing joint at a high enough pressure to cause the shear elements to rupture thereby causing the inner tubular member to extend relative to the outer tubular member through the predetermined distance until that the outer end of the inner tubular member is adjacent to the bottom of the well bore. Then, cement is pumped through the casing joint into the well bore until the region surrounding the casing joint is filled with cement. Next, the cement is allowed to harden so that the casing joint bonds to the subsea formation surrounding the bottom of the well bore.

Once the casing joint has been cemented in place, a drilling tool drills through the casing joint and the bottom of the well bore thereby extending the well bore deeper into the earth. Next, a logging tool is lowered into the extended section of the well bore to gather information on the surrounding sub sea formation conditions. If conditions permit, an additional casing string is then landed into the extended section of the well bore and cemented in place.

In another method according to the present invention, the extended section of the well bore is drilled before the casing joint is landed into the bottom of the first section. However, all other steps in this method are the same.

BRIEF DESCRIPTION OF THE DRAWINGS

The foregoing and other features of the present invention will be best appreciated with reference to the detailed description of the invention, which follows when read in conjunction with the accompanying drawings, wherein.

DETAILED DESCRIPTION OF THE INVENTION

Figure 1A:
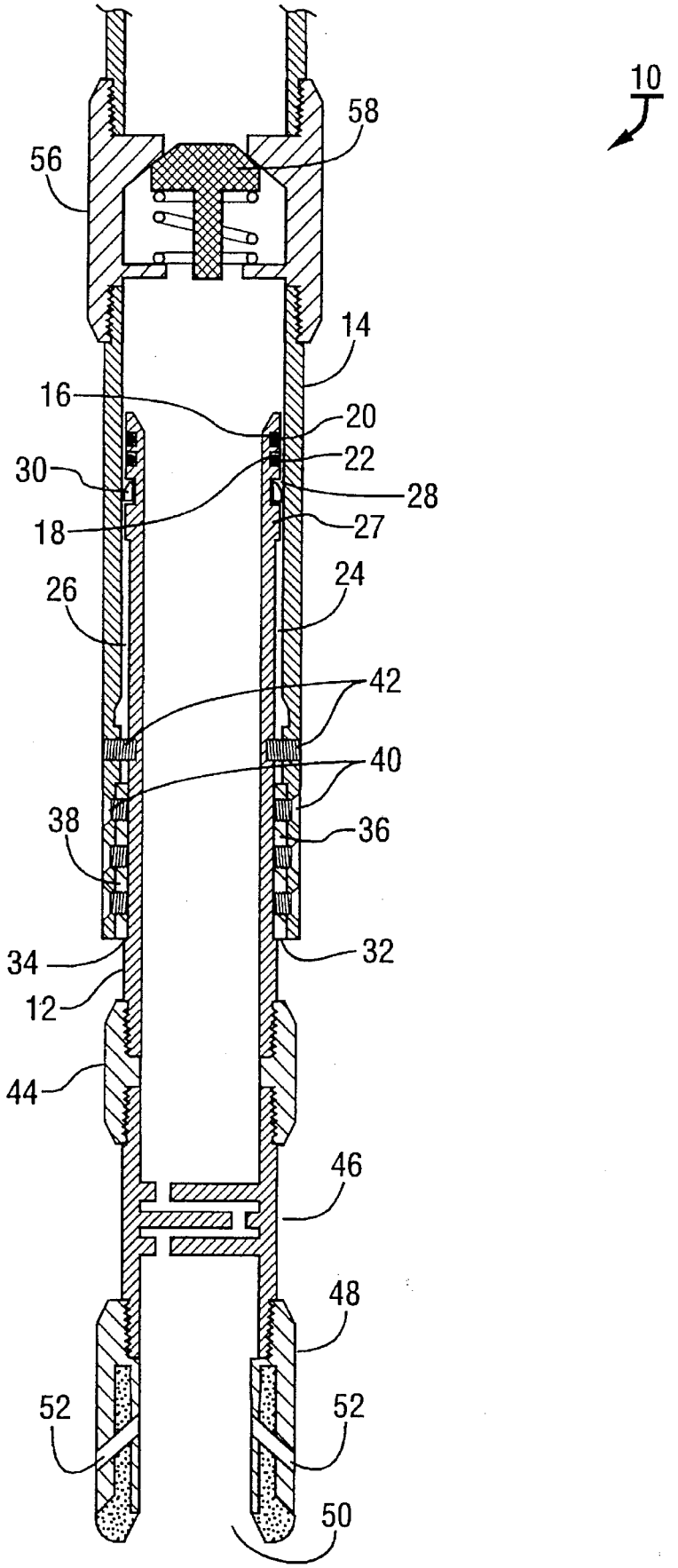
FIGS. 1A–D are lateral views of various embodiments of a telescoping casing joint according to the present invention.

Turning now to the drawings and referring initially to FIG. 1A, a casing joint for landing a casing string in a well bore of an oil or gas well is shown generally by reference numeral 10. The casing joint 10 includes an inner tubular member 12 and an outer tubular member 14. In one preferred embodiment, the inner tubular member has a diameter of approximately 9.625 inches and is about 17.0 feet long. In this embodiment, the outer tubular member 14 has a diameter of 10.625 inches and is approximately 16.0 feet long. As a person of ordinary skill in the art will recognize, the dimensions of both the inner and outer tubular members 12 and 14 may vary, e.g., the outer diameters may vary between 4.5 inches to 18.625 inches. Furthermore, both the inner and outer tubular members 12 and 14 are preferably formed of steel.

The inner tubular member 12 is partially disposed within the outer tubular member 14. The inner tubular member 12 is defined by an inner end which is disposed within the outer tubular member 14 and an outer end which is threaded. The inner tubular member 12 has a pair of annular grooves 16 and 18 formed around its outer circumferential surface at its inner end. A pair of elastomeric O-rings 20 and 22 are disposed within the pair of annular grooves 16 and 18, respectively, which hermetically seal the inner tubular member 12 to the outer tubular member 14. The inner tubular member 12 also has a pair of oppositely disposed longitudinal grooves 24 and 26 formed along its outer cylindrical surface. In one embodiment, the grooves 24 and 26 are 0.75 inches wide and 0.125 inches deep and extend along substantially the entire length of the inner tubular member 12. The longitudinal grooves 24 and 26 terminate at a shoulder portion 27 proximate to the inner end of the inner tubular member 12.

Figure 2:
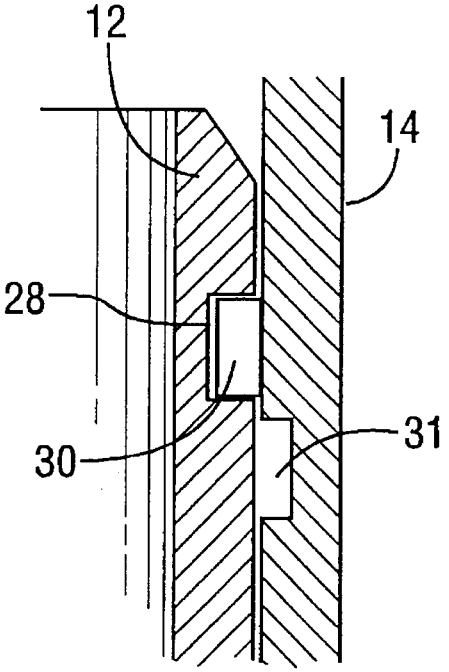
FIG. 2 is an enlarged view of an annular stop ring for limiting the axial movement of an inner tubular member relative to an outer tubular member of the telescoping casing joint according to the present invention.

The inner tubular member 12 also has an annular grove 28 disposed along its outer circumferential surface below the annular grooves 16 and 18. In one embodiment, the annular groove 28 is approximately 1.0 inch wide and 0.125 inches deep. An annular stop ring 30 is disposed within the annular groove 28, as shown in FIG. 2. In one embodiment, the annular stop ring 30 is approximately 1.0 inches wide and 0.1875 inches thick.

The outer tubular member 14 has an annular groove 31 formed in its outer circumferential surface, as shown in FIG. 2. The annular grove 31 is preferably 1.0 inches wide and 0.125 inches deep. As the inner tubular member 12 extends axially relative to the outer tubular member 14, the annular stop ring 30 travels along the inner cylindrical surface of the outer tubular member until it reaches the annular groove 31. As the annular stop ring 30 passes the annular groove 31, it slides into the annular groove locking itself therein. The inner tubular member 12 is thereby retained by the annular stop ring 30 thus stopping its axial movement relative to the outer tubular member 14.

Figure 2A:
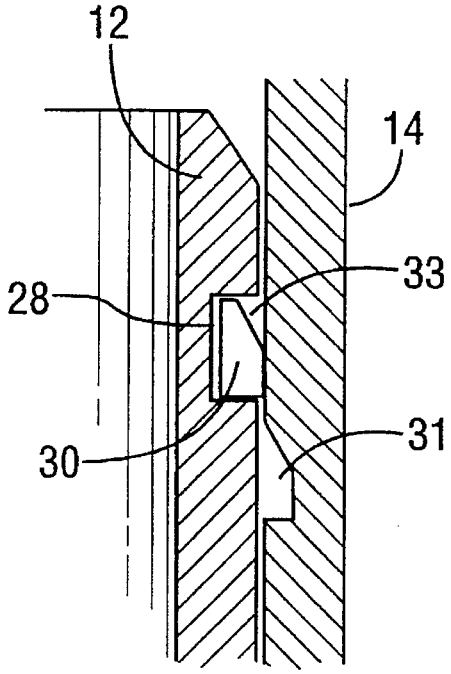
FIG. 2A is an enlarged view of an alternate embodiment of an annular stop ring for limiting the axial movement of an inner tubular member relative to an outer tubular member of the telescoping casing joint according to the present invention.

In an alternate embodiment, the annular stop ring 30 has a bevel-shaped portion 33 which allows the annular stop ring 30 to "pop out" of the annular grove 31 in response to a compressive load, as shown in FIG. 2A. Therefore, in this embodiment, the annular stop ring 30 limits the axial movement of the inner tubular member 12 relative to the outer tubular member in an extended condition, yet permits the inner tubular member 12 to retract within the outer tubular member 14 in response to a compressive load.

Figure 3:
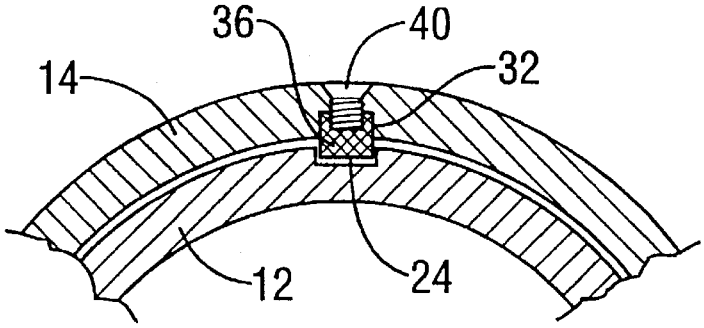
FIG. 3 is an enlarged partial cross-sectional view of an anti-rotation lug used to prevent the inner tubular member from rotating relative to the outer tubular member.

The outer tubular member 14 further includes a pair of oppositely disposed longitudinal grooves 32 and 34 formed at one end along its inner cylindrical surface. In one embodiment, a pair of anti-rotation lugs 36 and 38 are mounted within the longitudinal grooves 32 and 34 with six (6) 0.625 inch bolts 40, as shown in FIG. 3. The lugs 36 and 38 fit within the longitudinal grooves 24 and 26 formed in the inner tubular member 12 thereby preventing the inner tubular member from rotating relative to the outer tubular member 14, as shown in FIG. 3. Each lug is preferably formed of steel and is about 5.50 inches long, 0.75 inches wide and 0.25 inches thick.

Figure 4:
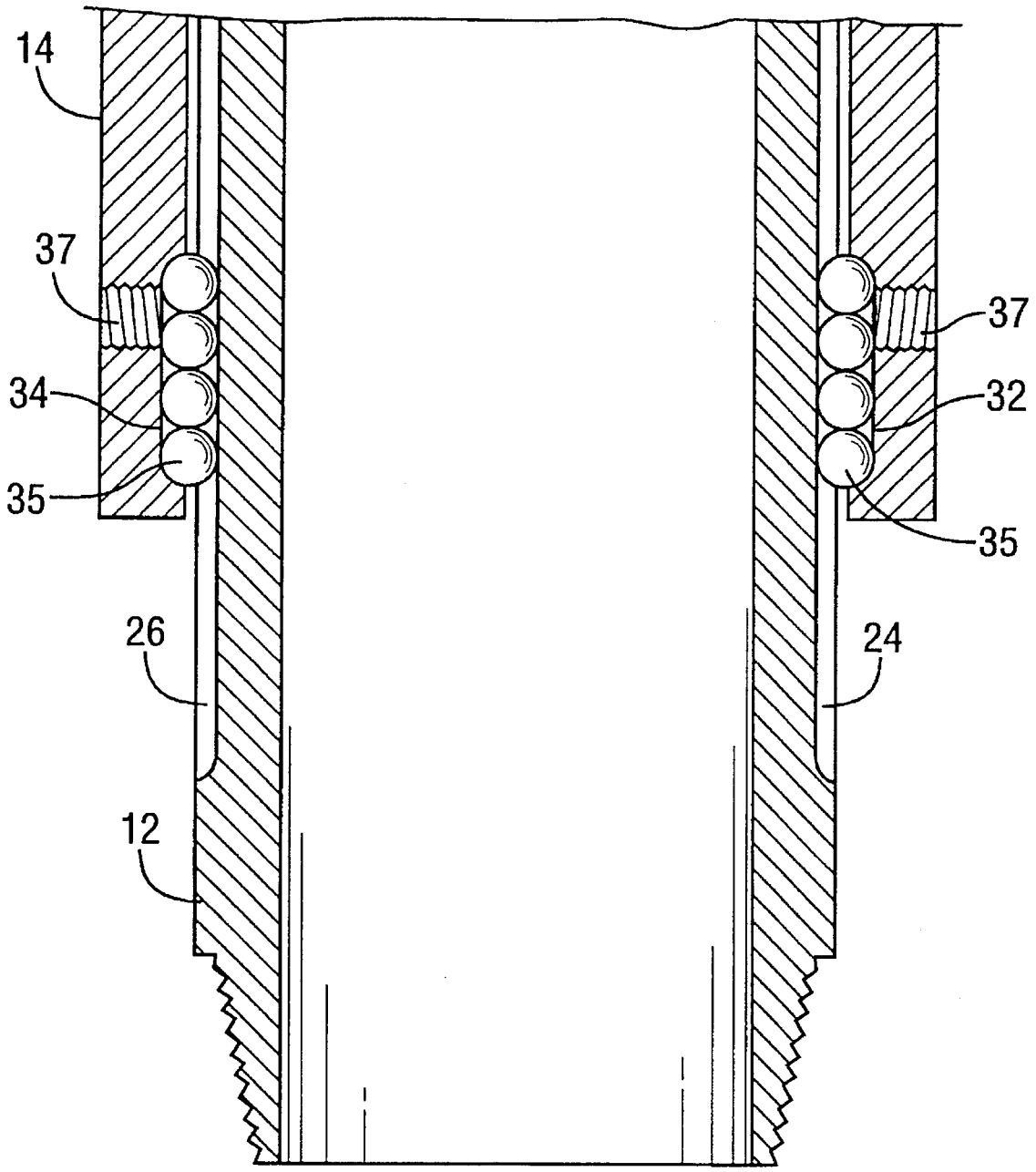
FIG. 4 is an enlarged view of an alternate embodiment of a pair of anti-rotation elements including a plurality of balls according to the present invention.
Figure 5:
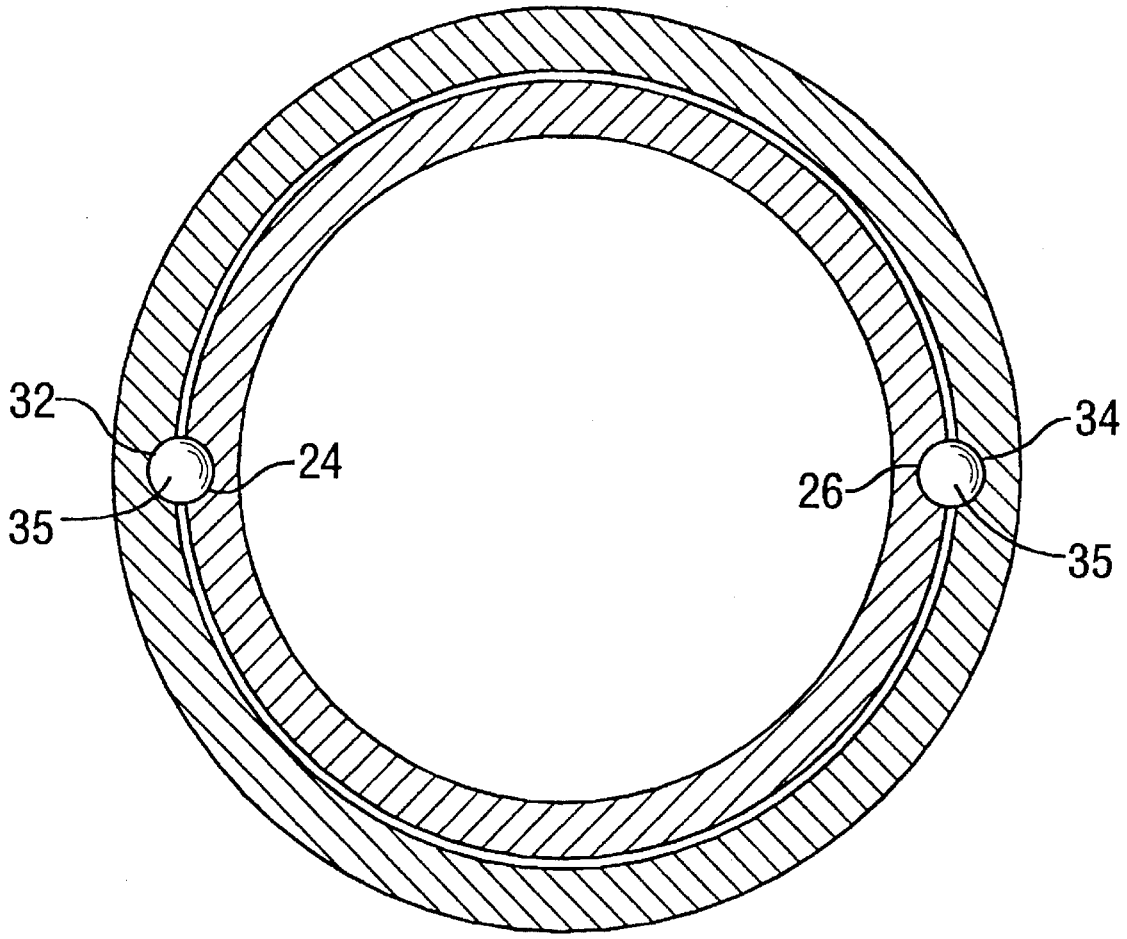
FIG. 5 is a cross-sectional view of the anti-rotation elements shown in FIG. 4.

In an alternative embodiment, a plurality of balls 35, preferably eight steel balls (2 pairs of four), fill the gaps between the longitudinal groves 24 and 32 and 26 and 34, respectively, as shown in FIG. 4. The balls 35 are inserted into the gaps between longitudinal grooves through threaded bores in the outer tubular member 14. Once all the balls 35 have been inserted into the gaps, threaded bolts 37 are screwed into the threaded bores to retain the balls within the grooves. The balls 35 perform the same function as the lugs 36 and 38 in preventing the inner tubular member 12 from rotating relative to the outer tubular member 14, as shown in FIG. 5. As the inner tubular member 12 moves axially relative to the outer tubular member 14, the balls 35 roll along the longitudinal grooves 24 and 26 in the inner tubular member, whereas the lugs 36 and 38 slide along these grooves.

As one of ordinary skill in the art will recognize, the exact size and number of lugs may be varied depending on the rotational load being transmitted between the inner and outer tubular members 12 and 14. Similarly, the exact size and number of balls 35 as well as the exact number of grooves 24, 26, 32, and 34 may be varied depending on the rotational load being transmitted between the inner and outer tubular members 12 and 14.

Figure 6:
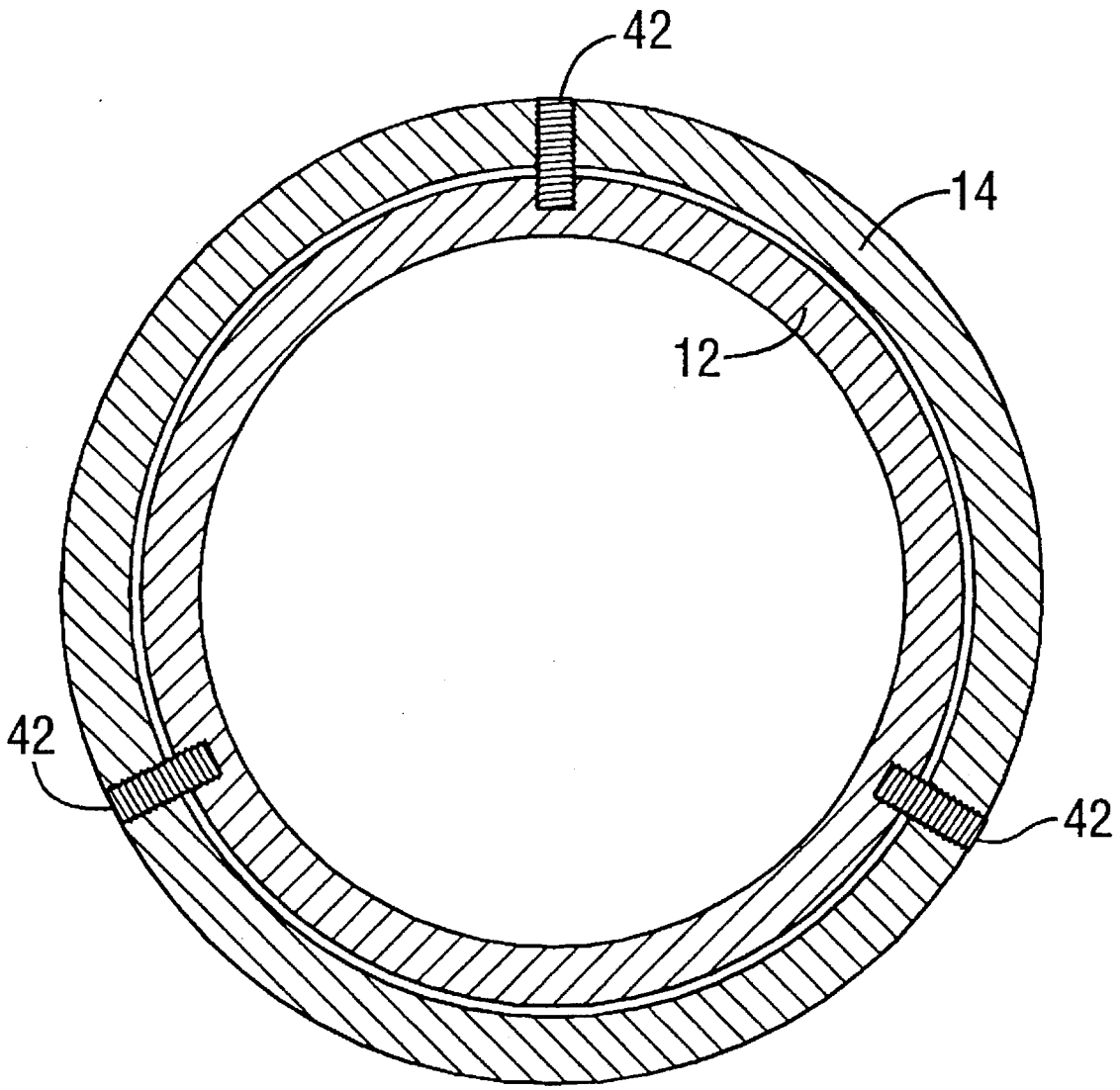
FIG. 6 is an enlarged cross-sectional view of a plurality of shear pins connecting the inner and outer tubular members of the casing joint according to the present invention.

A plurality of shear pins 42 are provided which attach the inner tubular member 12 to the outer tubular member 14 so as to prevent the inner tubular member from axially moving relative to the outer tubular member. The shear pins 42 are equally spaced around the perimeters of the inner and outer tubular members 12 and 14, as shown in FIG. 6. The shear pins 42 are designed to rupture at a predetermined load. The exact number of shear pins 42 and their size is selected depending upon the predetermined load. In one embodiment of the invention, the shear pins 42 are designed to shear at a load of approximately 28,000 lbs. In this embodiment, three (3) 0.625 inch shear pins are provided.

The casing joint 10 further includes a cylindrically-shaped casing collar 44 which couples the inner tubular member 12 to a series of baffle mechanisms or other flow restricting devices 46, as shown in FIG. 1A. The flow restriction device 46 has a threaded outer portion which screws into the casing collar 44 which in turn screws into the threaded outer end of the inner tubular member 12. The flow restricting device 46 is designed to restrict the flow of mud, cement and other fluids flowing through the casing string. The flow restricting device 46 creates a back pressure of the fluid which generates an axial tensile load which is applied to the casing joint 10. The casing joint 10 is designed so that at a predetermined pressure, the force generated by the back pressure created by the flow restricting device 46 causes the shear pins 42 to rupture thereby extending the inner tubular member 12 relative to the outer tubular member 14 until the annular stop ring 30, slides into the annular groove 31.

The casing joint 10 further includes a guide shoe 48 which is attached to the end of the casing collar 44, as shown in FIG. 1A. The guide shoe 48 is provided to guide the casing string through the well bore. The guide shoe 48 has a discharge bore 50 disposed along its central axis through which mud, cement and other fluids are ejected into the well bore. The guide shoe 48 further includes a plurality of discharge ports 52 disposed around its outer perimeter which are also provided for ejecting mud, cement and other fluids into the well bore. The guide shoe 48 is preferably a Guide Shoe Type 600 or 601 manufactured by Davis-Lynch, Inc.

The casing joint 10 further includes a float collar 56 which is attached to the upper end of the outer tubular member 14, as shown in FIG. 1A. The float collar 56 is provided to prevent fluids flowing through the casing joint 10 from flowing back up the casing string. The float collar 56 includes a valve mechanism 58 which is forced open by fluids flowing downward into the casing joint 10, but which is forced closed by the back flow of fluid. The valve mechanism 58 thus prevents fluid from flowing back up into the casing string. The float collar 56 is preferably a Float Collar Type 700-PVTS manufactured by Davis-Lynch, Inc.

Figure 1B:
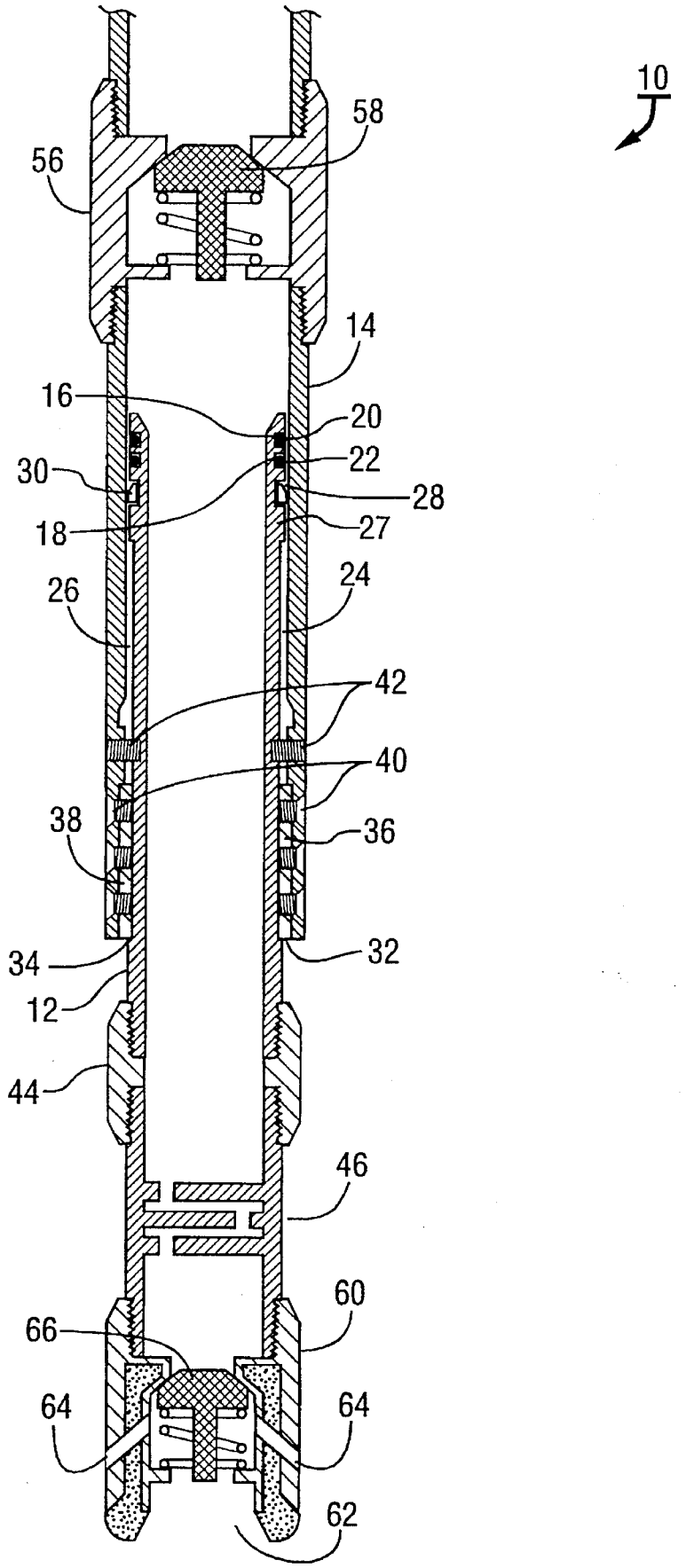

In an alternate embodiment, a float shoe 60 is provided in place of the guide shoe 48, as shown in FIG. 1B. The float shoe 60 both guides the casing string through the well bore and prevents fluid from flowing back up into the casing string. Like the guide shoe 48, the float shoe 60 has a discharge bore 62 disposed along its central axis through which mud, cement and other fluids are ejected into the well bore. The float shoe 60 also includes a plurality of discharge ports 64 disposed around its outer perimeter which are also provided for ejecting mud, cement and other fluids into the well bore. The float shoe 60 further includes a valve mechanism 66 which is forced open by fluids flowing downward into the casing joint 10, but which is forced closed by the back flow of fluid. The valve mechanism 66 thus prevents fluid from flowing back up the casing string. The float shoe 60 is preferably a Float Shoe Type 500-PVTS, 501-PVTS or 501 DV-PVTS manufactured by Davis-Lynch, Inc. The float shoe 60 is used in conjunction with the float collar 44 when additional control over the back flow is needed.

Figure 1C:
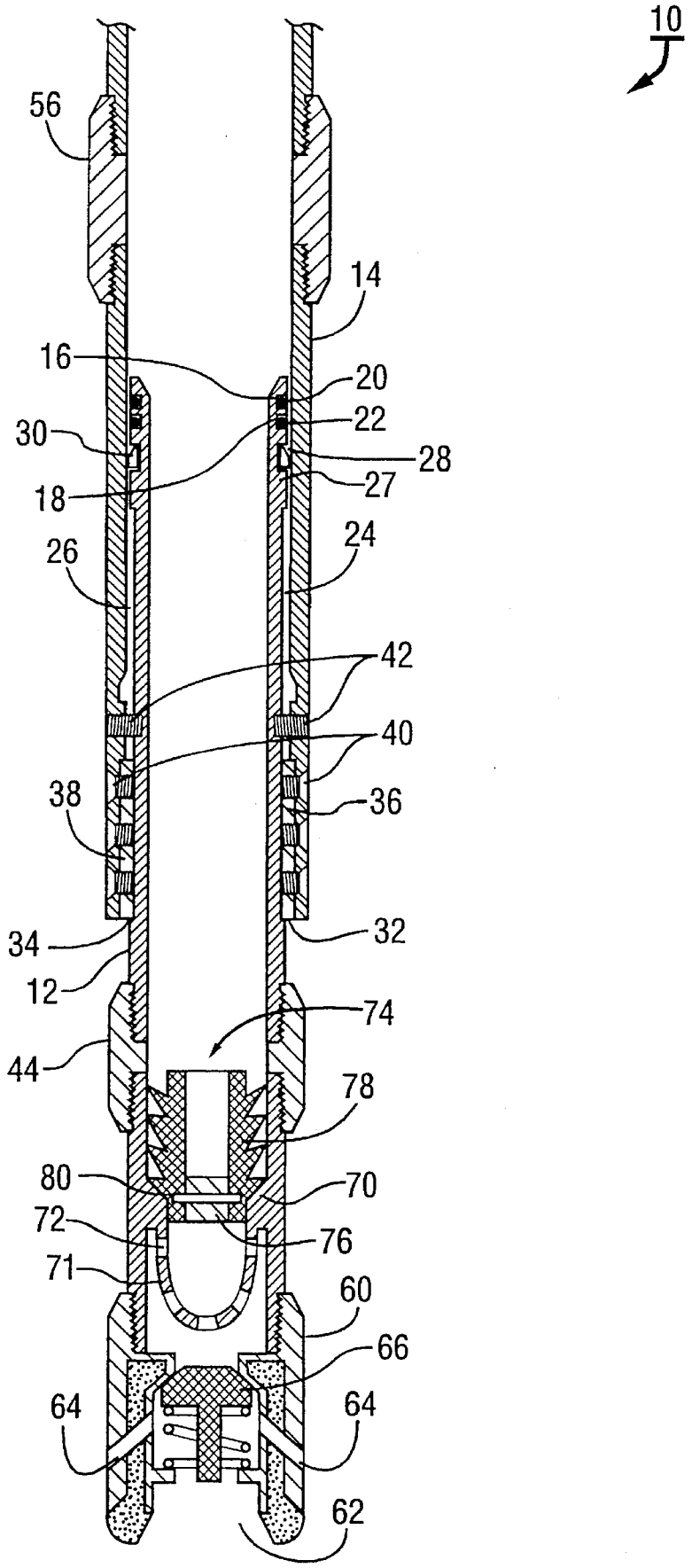
Figure 1D:
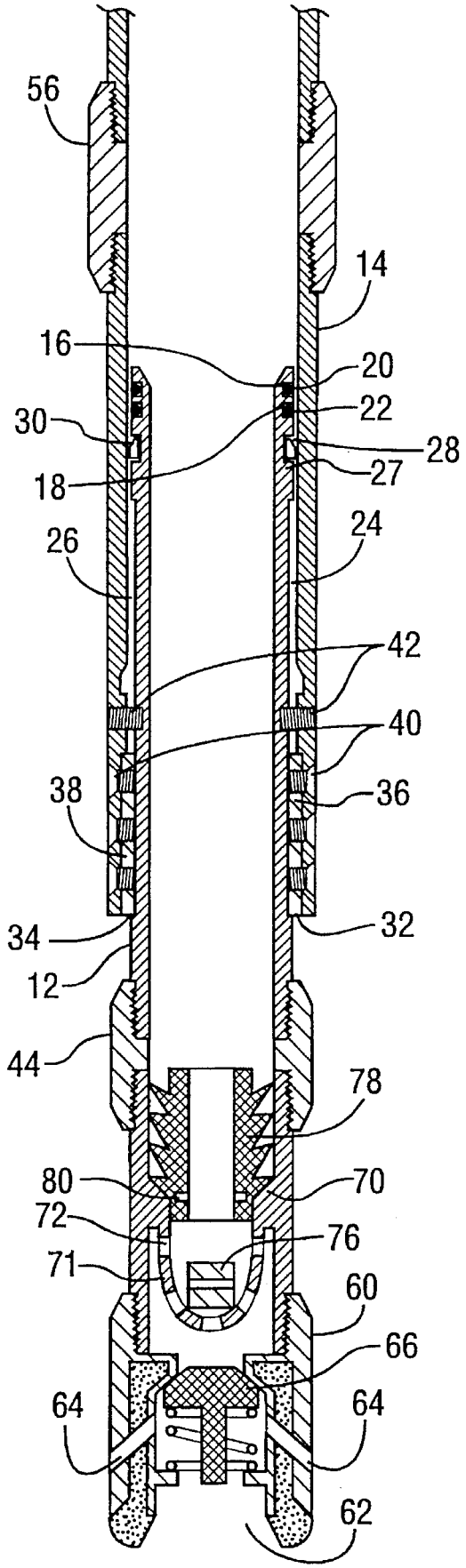

In yet another embodiment of the casing joint 10, the flow restricting device 46 includes a baffle ring 70 which is defined by a convergent opening which is narrower at one end than it is at the other, as shown in FIG. 1C. The narrower opening terminates in a basin portion 71 having a plurality of discharge outlets 72. A closing plug 74 is adapted to fit within the convergent opening of the baffle ring 70, as shown in FIG. 1C. The closing plug 74 is defined by an inner plug 76 which is disk-shaped and an outer plug 78 which is defined by a hollow bore and a plurality of branch-like sealing members which are disposed along its outer surface. The inner plug 76 is disposed within the hollow bore of the outer plug 78. The inner plug 76 is attached to the outer plug 78 by a pin 80 which is designed to rupture when the pressure of fluid in the casing joint 10 reaches a predetermined value. The closing plug 74 completely restricts the flow of mud, cement, and other fluids flowing through the casing string thereby creating a back pressure which causes the shear pins 42 to rupture. The pin 80 attaching the inner plug 76 to the outer plug 78 is designed to rupture at a higher pressure than that which will cause the shear pins 42 to rupture. The casing joint 10 is therefore designed so that the inner tubular member 12 reaches its extended condition before the inner plug 76 is "blown out" of the outer plug 78 allowing mud, cement, and other fluids to flow through the casing joint.

Once the inner plug 76 has been "blown out" of the outer plug 78 it is caught in the basin portion 71. However, fluids are allowed to flow past the baffle ring 70 through the discharge outlets 72. The fluids then can exit the casing joint 10 through the discharge bore 62 and discharge parts 64 in the float shoe 60. In an alternate embodiment, the closing plug 74 can block the discharge bore 50 of the guide shoe 48.

The casing joint 10 is used in a method of landing a casing string in a well bore for an oil or gas well. The method provides for controlling axial movements of the casing string relative to the well bore so as not to cause the casing string to become damaged. The method is particularly useful in landing casing strings in deviated wells drilled from offshore rigs.

Figure 7:
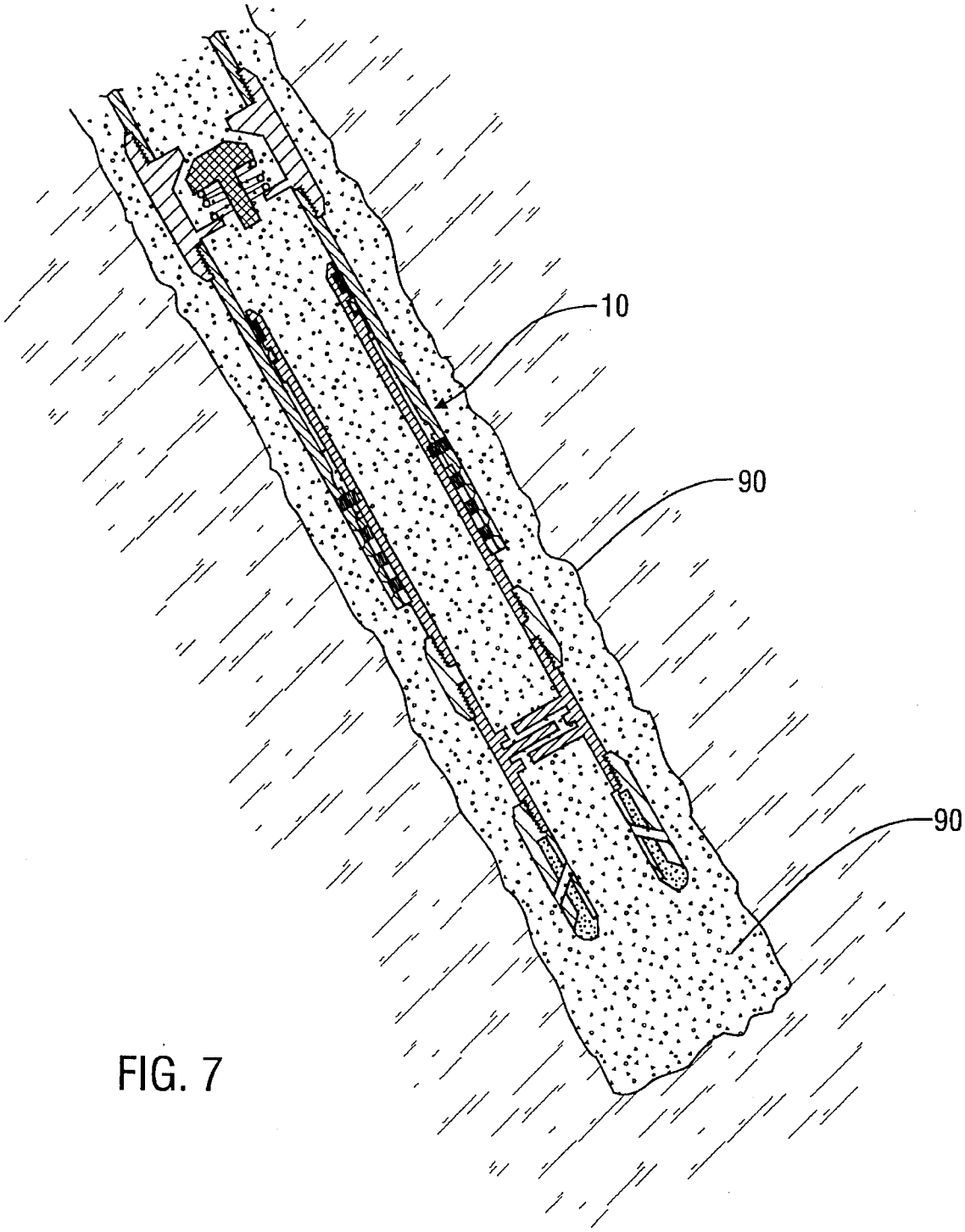
FIG. 7 is a diagram of the casing joint according to the present invention placed a predetermined distance above the bottom of a well bore.
Figure 8:
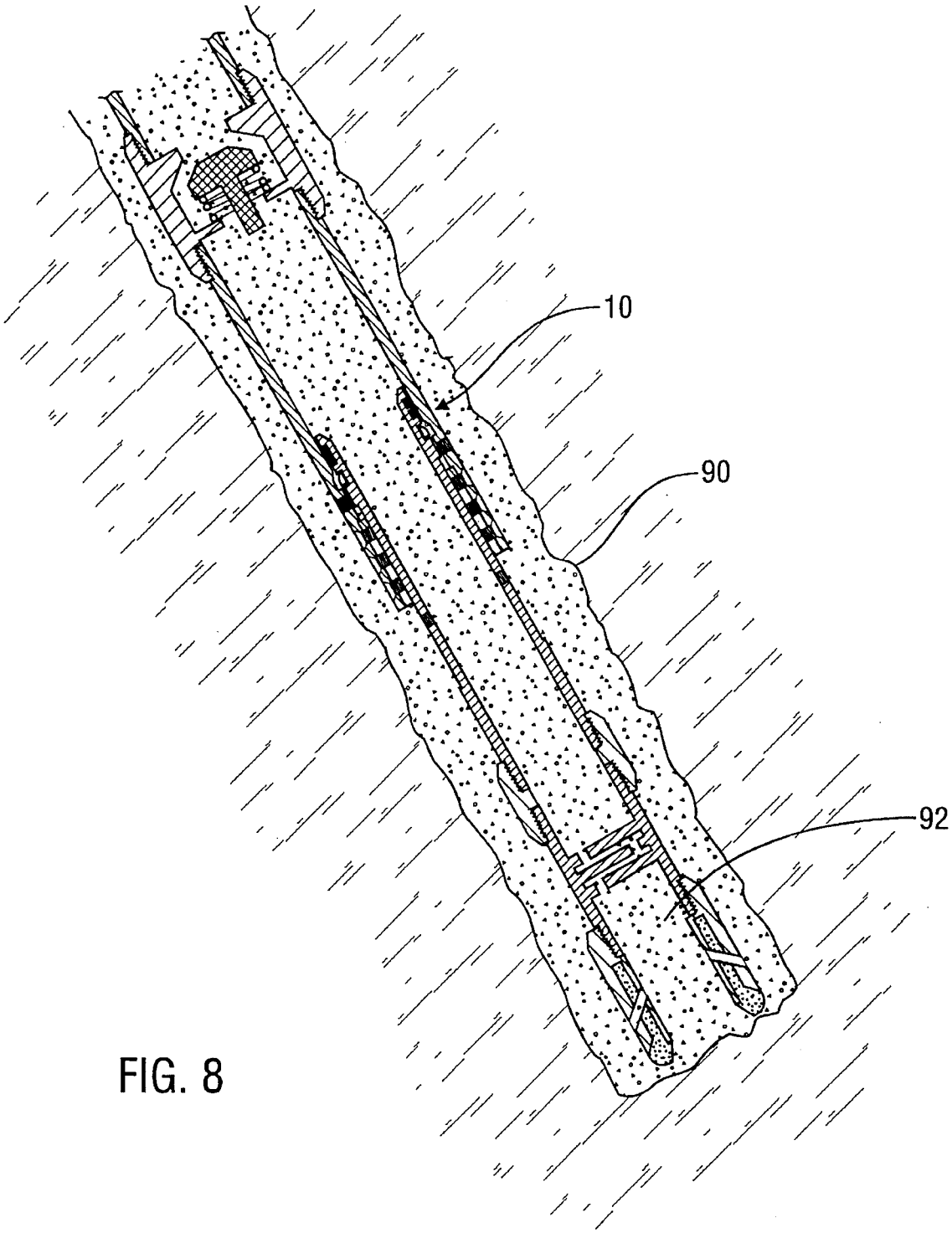
FIG. 8 is a diagram of the casing joint according to the present invention placed in a well bore in an extended condition.

In accordance with the method of the present invention, the casing joint 10 is landed a predetermined distance (approximately 15 feet) above the bottom of a well bore 90 filled with mud 92, as shown in FIG. 7. Next, mud 92 is pumped through the casing joint 10 at any desired rate sufficient to cause the shear pins 42 to rupture. In one preferred embodiment, a back pressure of 400 psi (lbs/in$^2$) is sufficient to cause the shear pins 42 to rupture. Once the shear pins 42 have ruptured, the inner tubular member 14 extends relative to the outer tubular member until the annular stop ring 30 reaches the annular groove 31. The casing joint 10 is preferably designed so that the annular stop ring 30 locks into the annular grove 31 just prior to reaching the bottom of the well bore 90. FIG. 8 shows the inner tubular member 12 in an extended condition prior to abutting the bottom of the well bore 90. In one preferred embodiment shown in FIGS. 1C and D, the mud is pumped through the casing joint 10 at a pressure of 900 psi until the pin 80 ruptures and the inner plug 76 is "blown out" of the outer plug. The mud then exits the casing joint 10 through the discharge outlets of the guide shoe 48 or float shoe 60.

Figure 9:
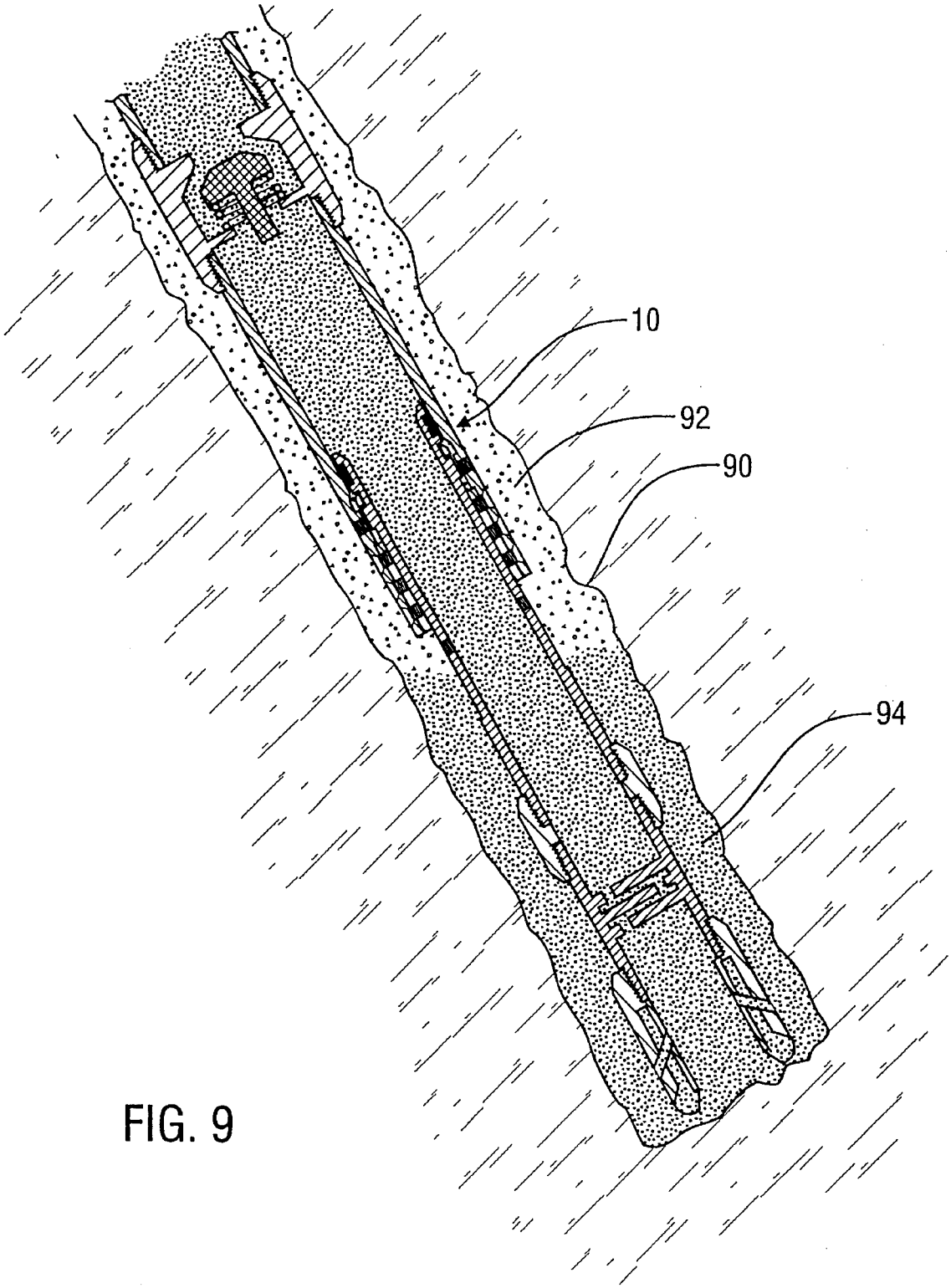
FIG. 9 is a diagram of a casing joint according to the present invention cemented into a well bore.

Once the inner tubular member 12 has been extended to the bottom of the well bore 90, cement 94 is pumped through the casing string to the casing joint 10, as shown in FIG. 9. The cement 94 is pumped behind the mud 92 and exits the casing joint 10 through the discharge outlets filling the well bore 90 in the region surrounding the casing joint 10. Mud 92 is then pumped through the casing string to force the cement out of the casing joint 10. Once the desired amount of cement 94 has been discharged into the well bore 90, the cement is then allowed to harden thereby bonding the casing joint 10 to the subsea formation surrounding the bottom of the well bore 90. If during these steps in the method, the casing string should unexpectedly move, the inner tubular member 12 will, in certain embodiments (e. g., those utilizing the annular stop ring 30 shown in FIG. 2A), retract into the outer tubular member 14.

Figure 10:
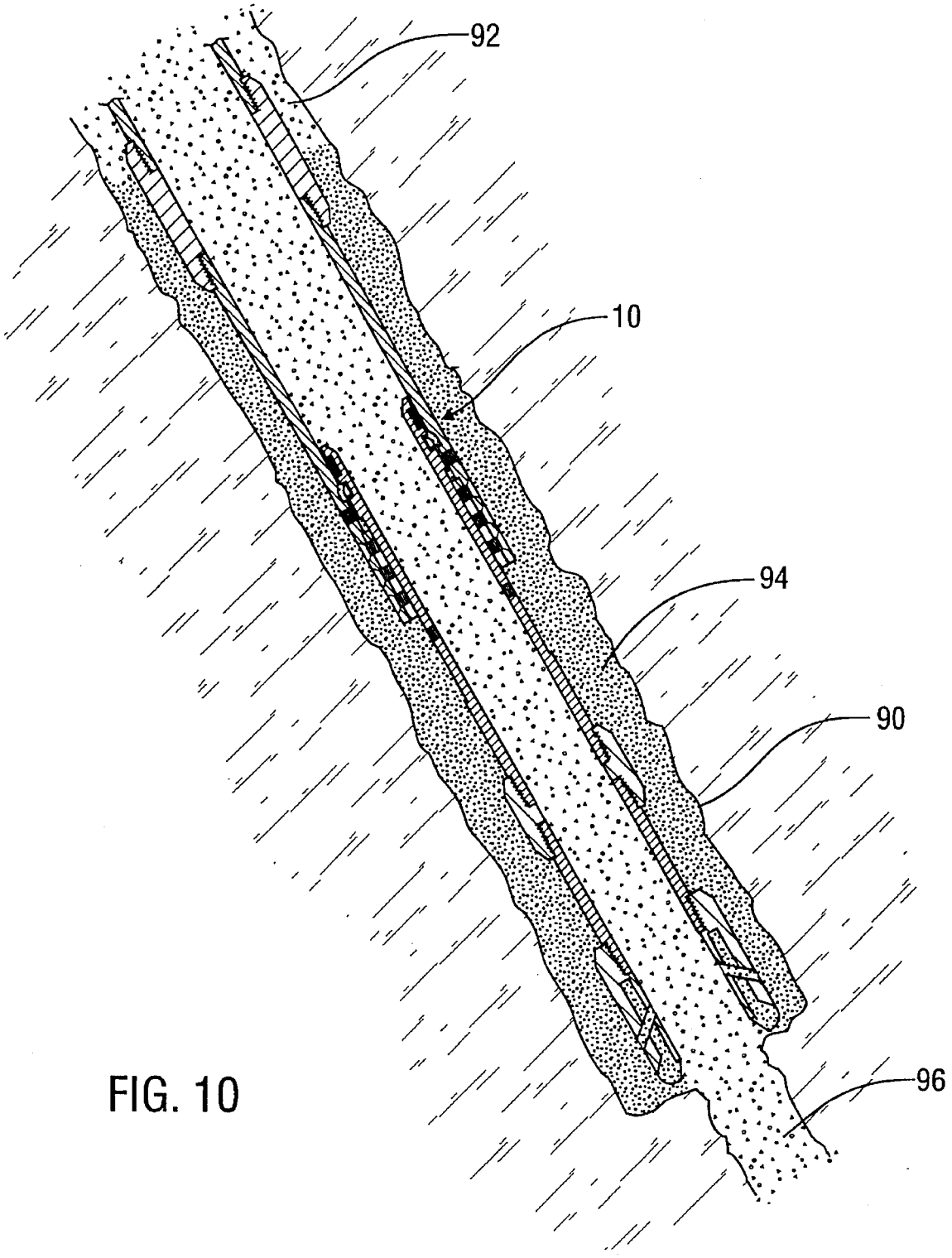
FIG. 10 is a diagram of a well bore having an upper and lower section showing a casing joint according to the present invention cemented into the upper section of the well bore.

After the cement has hardened and the casing string bonded in place, a drilling tool is then lowered through the casing string into the casing joint 10. The drilling tool is used to drill through the end of the casing joint 10, that is through the float collar 56, if one is used, through the closing plug 74, if one is used, through the guide shoe 48 or the float shoe 60, and any cement left inside the casing joint 10. After drilling through the casing joint 10, the drilling tool then proceeds to drill the next section 96 of the well bore 90 which is typically smaller in diameter than the previously drilled section, as shown in FIG. 10.

Once the deeper section 96 of the well bore has been drilled, a logging tool or other data gathering tool is then lowered into the deeper section to gather information, such as subsea oil or gas bearing formation conditions in this section. Since the casing joint 10 is cemented to the bottom of the upper section of the well bore 90, no rat hole is formed. Therefore, when logging and other tools are lowered into the well bore 90 they are not likely to get stuck in the region where the upper and lower sections of the well bore meet. Next, a casing string is landed into the deeper section of the well bore 90 and cemented in place. This method may then be repeated if additional deeper sections are desired.

In an alternate method, the deeper section of the well bore 96 is drilled before the casing joint 10 is landed into the bottom of the first section. All other steps in this method are the same, that is the steps of landing the casing joint 10 to the bottom of the first section; cementing the casing joint in the well bore; drilling through the casing joint; lowering a logging tool into the deeper section of the well bore; landing casing string into the deeper section; and cementing the casing string in the deeper section.

Alternate methods (not shown) may be used in landing a casing string in a well bore using the casing joint 10 according to the present invention. For example, the casing joint 10 may be lowered into the well bore in an extended condition until the bottom of the casing joint 10 reaches the bottom of the well bore 90. In this method, the force resulting from the impact of the casing joint 10 with the bottom of well bore causes the shear pins 42 to rupture and thereby forces the inner tubular member 12 to retract within the outer tubular member 14. In this method, a modified version of the casing joint 10 would be utilized. For instance, the locking ring 30 may be modified to prevent the inner tubular member 12 from retracting within the outer tubular member 14 beyond a certain point in response to external fluid pressures applying a compressive load to the inner and outer tubular members. Other methods of landing the casing string in the well bore are contemplated wherein the casing joint 10 is lowered in an extended condition.

Those skilled in the art who now have the benefit of the present disclosure will appreciate that the present invention may take many forms and embodiments. Some embodiments have been described so as to give an understanding of the invention. It is intended that these embodiments should be illustrative, and not limiting of the present invention. Rather, it is intended that the invention cover all modifications, equivalents and alternatives falling within the spirit and scope of the invention as defined by the appended claims.

What is claimed is:

1. A casing joint for use in landing a casing string in a well bore of an oil or gas well, comprising:

an outer tubular member connectable at one end to a first section of the casing string;

an inner tubular member partially disposed within the outer tubular member, said inner tubular member adapted to be axially movable relative to the outer tubular member and connectable at an outer end to a second section of the casing string;

a fluid being supplied to the outer tubular member at a first pressure and being discharged from the inner tubular member at a second pressure; and means for causing the inner tubular member to move axially relative to the outer tubular member in response to the difference between said first pressure and said second pressure.

2. The casting joint according to claim 1, further comprising at least one shear element attaching the inner tubular member to the outer tubular member, said at least one shear element being selected to shear at a predetermined load thereby enabling said inner tubular member to move axially relative to the outer tubular member.

3. The casing joint according to claim 1, further comprising at least one anti-rotation element disposed between the inner tubular member and the outer tubular member which prevents the inner tubular member from rotating relative to the outer tubular member.

4. The casing joint according to claim 1, further comprising an annular stop ring disposed between the inner tubular member and the outer tubular member which prevents the inner tubular member from moving axially relative to the outer tubular member.

5. The casing joint according to claim 1, wherein the means for causing the inner tubular member to move relative to the outer tubular member includes a float shoe coupled to the outer end of the inner tubular member, said float shoe having a valve mechanism which permits fluids to flow out of the inner tubular member but which prevents the fluids from flowing back into the inner tubular member.

6. The casing joint according to claim 1, wherein the means for causing the inner tubular member to move relative to the outer tubular member includes a flow restricting device coupled to the outer end of the inner tubular member which restricts the flow of fluid through the inner tubular member.

7. The casing joint according to claim 6, wherein the flow restricting device includes a baffle ring defined by a convergent inner surface having a first end and a second end which has a narrower diameter than the first end, said second end terminating at a basin portion having a plurality of discharge outlets.

8. The casing joint according to claim 7, further comprising a closing plug which fits within the convergent inner circumferential surface of the baffle ring so as to temporarily block the flow of fluids out of the casing joint, said closing plug being defined by an inner plug having a disk-shape and an outer plug having a hollow inner bore and a plurality of outer branch-like sealing members disposed along its outer surface, wherein the inner plug is disposed within the hollow bore of the outer plug.

9. The casing joint according to claim 8, further comprising a pin attaching the inner plug to the outer plug which is adapted to rupture at a higher fluid pressure than is necessary to shear the at least one shear element.

10. A casing joint for use in landing a casing string in a well bore of an oil or gas well, comprising:

an outer tubular member connectible at one end to a first section of the casing string;

an inner tubular member partially disposed within said outer tubular member, said inner tubular member adapted to be axially movable relative to said outer tubular member and connectible at an outer end to a second section of the casing string;

at least one shear element attaching the inner tubular member to the outer tubular member, said at least one shear element being selected to shear at a predetermined load thereby enabling said inner tubular member to move axially relative to the outer tubular member; and at least one anti-rotation element disposed between the inner tubular member and the outer tubular member which prevents the inner tubular member from rotating relative to the outer tubular member.

11. The casing joint according to claim 10, further comprising a stop ring disposed between the inner tubular member and outer tubular member which limits the axial movement of the inner tubular member relative to the outer tubular member.

12. A casing joint for use in landing a casing string in a well bore of an oil or gas well, comprising:

an outer tubular member connectible at one end to a first section of the casing string;

an inner tubular member partially disposed within said outer tubular member, said inner tubular member adapted to be axially movable relative to said outer tubular member and connectible at an outer end to a second section of the casing string;

at least one shear element attaching the inner tubular member to the outer tubular member, said at least one shear element being selected to shear at a predetermined load thereby enabling said inner tubular member to move axially relative to the outer tubular member; and a stop ring disposed between the inner tubular member and outer tubular member which limits the axial movement of the inner tubular member relative to the outer tubular member.

13. The casing joint according to claim 12, further comprising at least one anti-rotation element disposed between the inner tubular member and the outer tubular member which prevents the inner tubular member from rotating relative to the outer tubular member.

14. The casing joint according to claims 1, 10, or 12, further comprising a cylindrically-shaped float collar coupled to the one end of the outer tubular member, said float collar having a valve mechanism disposed within its inner cylindrical surface which permits fluids to flow through the float collar into the inner and outer tubular members but which prevents the fluids from flowing back through the float collar into the casing string.

15. The casing joint according to claim 14, further comprising a guide shoe coupled to the outer end of the inner tubular member which guides the casing joint through the well bore, said guide shoe having a discharge bore disposed along its central axis and a plurality of discharge ports disposed around its outer perimeter.

16. The casing joint according to claim 14, further comprising a float shoe coupled to the outer end of the inner tubular member, said float shoe having a valve mechanism which permits fluids to flow out of the inner tubular member but which prevents the fluids from flowing back into the inner tubular member, and a discharge bore disposed along its central axis and a plurality of discharge ports disposed around its outer perimeter.

17. The casing joint according to claim 10 or 12, further comprising a float shoe coupled to the outer end of the inner tubular member, said float shoe having a valve mechanism which permits fluids to flow out of the inner tubular member but which prevents the fluids from flowing back into the inner tubular member, a discharge bore disposed along its central axis and a plurality of discharge ports disposed around its outer perimeter.

18. The casing joint according to claim 10 or 12, further comprising a flow restricting device coupled to the outer end of the inner tubular member which restricts the flow of fluids through the inner tubular member so that a back pressure is created at a predetermined pressure which causes the at least one shear element to shear thereby enabling the inner tubular member to move axially relative to the outer tubular member.

19. The casing joint according to claim 18, wherein the flow restricting device includes a baffle ring defined by a convergent inner surface having a first end and a second end which has a narrower diameter than the first end, said second end terminating at a basin portion having a plurality of discharge outlets.

20. The casing joint according to claim 19, further comprising a closing plug which fits within the convergent inner circumferential surface of the baffle ring so as to temporarily block the flow of fluids out of the casing joint, said closing plug being defined by an inner plug having a disk-shape and an outer plug having a hollow inner bore and a plurality of outer branch-like sealing members disposed along its outer surface, wherein the inner plug is disposed within the hollow bore of the outer plug.

21. The casing joint according to claim 20, further comprising a pin attaching the inner plug to the outer plug which is adapted to rupture at a higher fluid pressure than is necessary to shear the at least one shear element.

22. The casing joint according to claim 1, 10 or 12, wherein the inner tubular member further comprises at least one annular groove disposed proximate to an inner end of the inner tubular member which is disposed within the outer tubular member.

23. The casing joint according to claim 22, further comprising an elastomeric O-ring which is disposed within the at least one annular groove, said elastomeric O-ring hermetically sealing said inner tubular member to said outer tubular member.

24. The casing joint according to claim 1, 10 or 12, wherein the at least one shearing element includes a plurality of shear pins equally spaced around the circumferential perimeters of the inner and outer tubular members.

25. The casing joint according to claim 1, 10 or 13, wherein the at least one anti-rotation element includes a lug which slides along a longitudinal groove formed in the inner tubular member as the inner tubular member moves axially relative to the outer tubular member.

26. The casing joint according to claim 1, 10 or 13, wherein the at least one anti-rotation element includes a plurality of balls which roll along a longitudinal groove formed in the inner tubular member as the inner tubular member moves axially relative to the outer tubular member.

* * * * *

UNITED STATES PATENT AND TRADEMARK OFFICE

CERTIFICATE OF CORRECTION

PATENT NO. : 5,566,772

DATED : October 22, 1996

INVENTOR(S) : Malcolm G. Coone and Thomas L. Kelley

It is certified that error appears in the above-indentified patent and that said Letters Patent is hereby corrected as shown below:

On the title page, item [54] and column 1, line 2, "CASTING" should read --CASING--.

IN THE DRAWINGS

Figure 7, the lowermost number "90" should be --92--.

Column 4, line 36, after "member" insert --12--.

Signed and Sealed this

Twenty-first Day of January, 1997

*Attest:*

*Attesting Officer*

BRUCE LEHMAN

*Commissioner of Patents and Trademarks*